US010477293B2

(12) United States Patent
Grell et al.

(10) Patent No.: US 10,477,293 B2
(45) Date of Patent: Nov. 12, 2019

(54) HEADPHONE

(71) Applicant: Sennheiser electronic GmbH & Co. KG, Wedemark (DE)

(72) Inventors: Axel Grell, Burgdorf (DE); Kornelia Kaddig, Wietze (DE); Christoph Greger, Delligsen (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 15/901,984

(22) Filed: Feb. 22, 2018

(65) Prior Publication Data

US 2018/0249237 A1 Aug. 30, 2018

(30) Foreign Application Priority Data

Feb. 28, 2017 (DE) ..... 10 2017 104 167

(51) Int. Cl.
*H04R 1/10* (2006.01)
*H04R 1/28* (2006.01)

(52) U.S. Cl.
CPC ..... *H04R 1/1008* (2013.01); *H04R 1/1058* (2013.01); *H04R 1/2811* (2013.01)

(58) Field of Classification Search
CPC .. H04R 1/2803; H04R 1/2811; H04R 1/1008; H04R 1/1058
See application file for complete search history.

(56) References Cited

U.S. PATENT DOCUMENTS

| | | | | |
|---|---|---|---|---|
| 4,928,788 | A | 5/1990 | Erickson | |
| 6,636,610 | B1 * | 10/2003 | Betts | H04R 1/2811 181/153 |
| 2003/0042068 | A1 * | 3/2003 | Lee | H04R 1/2803 181/155 |
| 2009/0226023 | A1 * | 9/2009 | Akino | H04R 1/1008 381/374 |

FOREIGN PATENT DOCUMENTS

| | | |
|---|---|---|
| DE | 26 14 729 | 10/1976 |
| DE | 40 00 132 | 7/1991 |
| DE | 102007005620 | 8/2008 |
| EP | 1 292 170 | 3/2003 |
| EP | 2830324 | 1/2015 |
| GB | 2 181 620 | 4/1987 |
| JP | H02-23000 | 1/1990 |

OTHER PUBLICATIONS

Images from the video beats by dr dre solo 2 / solo 3 wireless repair one side not working / part 2—YouTube (www[dot]youtube[dot]com/watch?v=dskF0dO1Iw0) [investigated on Jul. 12, 2017].
Online magazine: The Verge: Beats Solo 3 Review: Decent Sound, Better Wireless. Vlad Savov. pp. 1-6. Dec. 22, 2016. (www[dot-]theverge[dot]com/2016/12/22/14051984/beats-solo-3-review-apple-headphones) [investigated on Jul. 12, 2017].

* cited by examiner

*Primary Examiner* — Sunita Joshi
(74) *Attorney, Agent, or Firm* — Haug Partners LLP

(57) ABSTRACT

Headphones are provided with a rear wall that is designed to be inwardly convex, so that sound which is radiated from the rear side of the sound-generating membrane of a sound generator is advantageously distributed in the headphone housing.

3 Claims, 2 Drawing Sheets

HEADPHONE

The present application claims priority from German Patent Application No. 10 2017 104 167.2 filed on Feb. 28, 2017, the disclosure of which is incorporated herein by reference in their entirety.

FIELD OF THE INVENTION

It is noted that citation or identification of any document in this application is not an admission that such document is available as prior art to the present invention.

The present invention relates to headphones. Headphones typically include at least one, preferably two earcups, each of which is equipped with a playback transducer. Such earcups also include an earpad which either surrounds or lies over the user's ear during normal use of the headphones.

FIG. 1 shows a known, typical design of a headphone earcup. This shows that the headphone earcup 10 consists of a housing 11 which contains an electroacoustic sound generator 14. The sound generator 14 contains a membrane 15 which is deflected when electrical signals are applied to it, so that a sound is generated by the membrane 15. The earcup has an earpad ring 12 which surrounds or lies over the ear 30 of a user during normal use of the headphones.

EP2830324 describes headphones which surround the ear.

DE102007005620 describes a sound transducer for headphones.

Depending on the desired application, the housing 11 may be designed to allow sound to pass through (open headphones) or to prevent most sound from passing through (closed headphones). With open headphones, a desired sound reproduction over the frequency range of human hearing can normally be realised more easily than with closed headphones. One of the main reasons for this is that, besides the sound it emits towards the ear, the membrane 15 also generates and radiates sound on its rear side, facing away from the ear. In open headphones, this sound is radiated into the environment and does not interfere with the generation of the sound that is directed towards the ear. In closed headphones, however, the sound that is radiated from the rear side of the membrane is reflected on the inside of the housing 11, giving rise to local pressure increases in the housing, which can even affect the oscillation of the membrane 15.

On the other hand, closed headphones offer the advantage that the user is shielded to a certain degree from external noises, and the headphones radiate little sound to the user's environment, with the result that people in the vicinity of the user are exposed to less disturbing noise from the headphones than with open headphones. Closed headphones may optionally also be furnished with apertures, which however are dimensioned such that they do not significantly detract from the shielding effect.

In the German patent application which is authoritative for priority, the German Patent and Trademark Office investigated the following documents: DE 26 14 729A1, DE 40 00 132 A1, GB 2 181 620 A, U.S. Pat. No. 6,636,610 B1, U.S. Pat. No. 4,928,788 A, EP 1 292 170 A2, JP H02-23 000 A, Images from the video "beats by dr dre solo 2/solo 3 wireless repair one side not working/part 2—YouTube (www[dot]youtube[dot]com/watch? v=dskF0dO1Iw0) [investigated on Jul. 12, 2017] and "Online magazine: THE VERGE: BEATS SOLO 3 REVIEW: DECENT SOUND, BETTER WIRELESS. Vlad Savoy. pp. 1-6. Dec. 22, 2016. (www[dot]theverge[dot]com/2016/12/22/14051984/beats-solo-3-review-apple-headphones) [investigated on Jul. 12, 2017].

SUMMARY OF THE INVENTION

The object of the present invention consists in improving the sound reproduction of closed headphones.

Thus, according to the invention headphones are provided with one or two headphone earcups. Each headphone earcup has an electroacoustic sound generator with a membrane for emitting sound, a baffle for supporting the sound generator, a rear wall, a surrounding section arranged peripherally between the rear wall and the baffle, and an earpad ring. When the headphones are in use, the earpad ring surrounds the user's ear or lies over the ear. When the headphones are in use, the membrane is then arranged between the rear wall and the user's ear, and a rear side of the membrane faces the rear wall. The baffle and the membrane together separate a front volume closest to the user's ear from a rear volume which is farther from the user's ear. The rear volume is delimited by the membrane, the baffle, the rear wall and the peripheral section. The rear volume is constructed acoustically as a contiguous volume, so that sound which is radiated from the rear of the membrane reaches the rear wall. The rear wall is constructed with a convex inward curvature, so that the rear wall is closer to the sound generator in a middle area of the sound generator than at the edge of the sound generator. The peripheral section flares in the manner of a funnel progressively from the outer edge of the convex rear wall towards the baffle.

According to one aspect of the present invention, the membrane has an outer diameter and the convex rear wall has a diameter, and the diameter of the concave rear wall is greater than the outer diameter of the membrane.

According to an aspect of the present invention, the rear wall and the peripheral section are designed to be largely impermeable to sound.

According to an aspect of the present invention, the inner sides of the peripheral section converge towards the baffle at an acute angle.

According to an aspect of the present invention, part of the sound radiated from the rear side of the membrane is reflected at the convex rear wall towards an outer region of the rear volume in which the inner sides of the peripheral section converge on the baffle at an acute angle.

According to an aspect of the present invention, the side walls of the rear volume formed by the peripheral section are not aligned parallel to each other.

According to an aspect of the present invention, the baffle contains apertures which are covered with acoustic resistors made of an open-pored material.

BRIEF DESCRIPTION OF THE DRAWINGS

Advantages and embodiments of the invention will be explained in greater detail in the following text with reference to the drawing.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
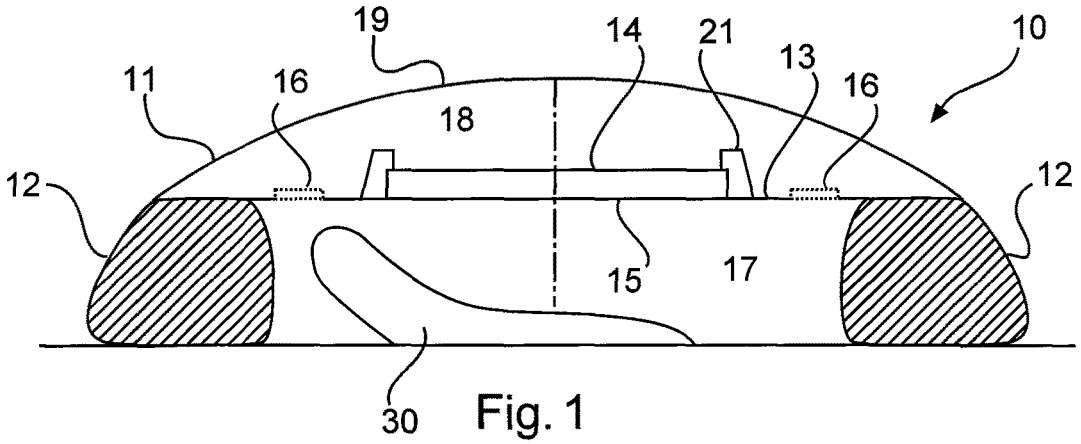
FIG. 1 is a schematic representation of a cross-section through an earcup of a headphone according to the related art.

FIG. 1 is a schematic representation of a cross-section through an earcup of a headphone according to the related art, wherein the headphone earcup of a closed headphone is represented. The headphone earcup 10 consists of a housing 11 which contains an electroacoustic sound generator 14. The housing 11 is designed to be mostly impermeable to sound and has a rear wall 19. The sound generator 14 is supported by a baffle 13 with the aid of a retaining device 21, wherein the baffle 13 is fastened to the housing 11 from the inside. Optionally, the baffle 13 may be furnished with apertures which may be covered with acoustic resistors 16 made of an open-pored material. The earcup has an earpad ring 12 which surrounds the user's ear 30 or lies over the ear during normal use of the headphones. The sound generator 14 contains a membrane 15 which is deflected when electrical signals are applied to it, so that a sound is generated by the membrane 15.

The membrane 15 has a front side, which faces towards the user's ear 30 when the headphones are used normally. A front volume 17 is created in front of the front side of the membrane 15, which volume is surrounded by the earpad ring 12 and is also delimited by the baffle 13 with the acoustic resistors 16, the membrane 15, optionally a part of the housing 11, the ear 30 and possibly a part of the user's head. The other side of the membrane 15 is the rear side, which correspondingly faces away from the user's ear 30. A rear volume 18 is created behind the baffle, which volume is delimited by the rear side of the membrane 15, the baffle 13 with the acoustic resistors 16 and the inner side of the housing 11.

The useful sound is radiated from the front side of the membrane 15 into the front volume 17, towards the ear 30. However, the membrane 15 also emits sound from its rear side, which is radiated into the rear volume 18. With closed headphones, the sound radiated from the rear side of the membrane 15 is reflected by the inner side of the housing 11 and after reflection some of this sound passes from the rear volume 18 into the front volume 17. There, this sound is superimposed on the useful sound as noise. This superimposition has the effects of both partially cancelling and partially exaggerating the useful sound, thereby creating undesirable changes in the frequency response of the headphones.

Moreover, local pressure increases in the housing 11 occur in the rear volume 18, which may have unwanted effects on the oscillation of the membrane 15. In the headphone earcup according to the related art represented in FIG. 1, the rear wall of the housing 11 is structured so that its surface facing the rear volume 18 is concave. Consequently, the rear wall is positioned farther from the sound generator 14 in a middle area of the sound generator than at the edge of the sound generator. With such a construction, in accordance with the principle of a concave mirror known from the field of optics the reflection of sound on the inner wall of the housing 11 can result in a local pressure increase in the middle region of the rear side of the sound generator 14. This local pressure increase acts on the membrane 15 and interferes with the desired waveform of the membrane, resulting in the impaired frequency response of the headphones.

Alternatively, the rear wall of the housing 11 may be designed so that it is partly flat and parallel to the sound generator 14. In this case, standing waves may form at some frequencies inside the housing and these may also impair the desired frequency response.

Figure 2:
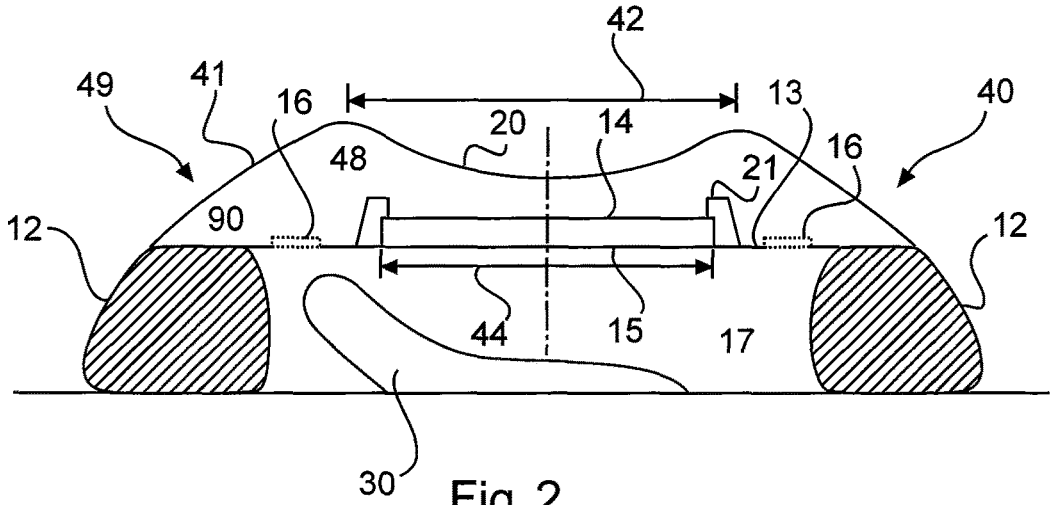
FIG. 2 is a schematic representation of a cross-section through an earcup of a headphone according to a first embodiment.

FIG. 2 is a schematic representation of a cross-section through an earcup of a headphone according to a first embodiment of the invention, wherein the headphone earcup of closed headphones is represented. The construction is extensively the same as the construction shown in FIG. 1. The headphone earcup 40 consists of a housing 41 which contains an electroacoustic sound generator 14. The housing 41 is designed to be largely impermeable to sound The sound generator 14 is supported with the aid of a retaining device 21 by a baffle 13 which is fastened to the housing 41 from inside. Optionally, the baffle 13 may contain apertures which may be covered with acoustic resistors 16 made of an open-pored material. The housing 41 also has a peripheral section 49 which is arranged between the rear wall 20 and the baffle 13. The peripheral section 49 extends towards the baffle 13 from the outer edge of the rear wall 20 and thus forms the side walls of a rear volume 48. The earcup has an earpad ring 12 which surrounds the user's ear 30 or lies over the ear during normal use of the headphones. The sound generator 14 contains a membrane 15 which is deflected when electrical signals are applied to it, so that a sound is generated by the membrane 15. The membrane has an outer diameter 44.

The membrane 15 has a front side which faces towards the user's ear 30 when the headphones are used normally. A front volume 17 is created in front of the front side of the membrane 15, which volume is surrounded by the earpad ring 12 and is also delimited by the baffle 13 with the acoustic resistors 16, the membrane 15, optionally a part of the housing 41, the ear 30 and possibly a part of the user's head. The other side of the membrane 15 is the rear side, which correspondingly faces away from the user's ear 30. A rear volume 48 is created behind the baffle, which volume is delimited by the rear side of the membrane 15, the baffle 13 with the acoustic resistors 16, the peripheral section 49 and the rear wall 20. The rear volume 48 is constructed acoustically as a contiguous volume, so that sound which is radiated from the rear of the membrane 15 reaches the rear wall 20 and can be reflected by the rear wall 20.

The useful sound is radiated from the front side of the membrane 15 into the front volume 17, towards the ear 30. However, the membrane 15 also emits sound from its rear side, which is radiated into the rear volume 48. Unlike the headphones of FIG. 1, in the first embodiment the rear wall 20 of the housing is designed to be convex towards the rear volume 48. Accordingly, the rear wall 20 is closer to the sound generator 14 in the middle region of the sound generator than at the edge of the sound generator. The convex rear wall 20 has a diameter 42. The diameter 42 of the convex rear wall 20 is preferably larger than the outer diameter 44 of the membrane 15.

The inner side of the peripheral section 49 is part of the delimitation of the rear volume 48. The peripheral section 49 extends from the outer edge of the convex rear wall 20 towards the baffle 13, thereby forming the side walls of the rear volume 48. The peripheral section 49 flares in the manner of a funnel progressively from the convex rear wall 20 towards the baffle 13, so the side walls of the rear volume 48 are not aligned parallel to each other. Consequently, an outer region 90 of the rear volume 48 is created in which the inner sides of the peripheral section 49 converge towards the baffle 13 at an acute angle.

The inventive thought consists in that the sound which is radiated into the rear volume 48 from the rear side of the membrane 15, is distributed as evenly as possible throughout the entire rear volume 48 when it is reflected from the convex rear wall 20, so that local pressure increases are reduced. After reflection, much of the sound is directed towards the earpad ring 12 and the outer region 90 of the rear volume 48, for example. Optionally, the rear volume 48 may be partly filled with open-pored insulating material to dampen the sound. In the outer region 90 of the rear volume 48, the peripheral section 49 is aligned at an angle to the baffle 13 and causes multiple irregular reflections, resulting in attenuation of the sound which is reflected into the outer region 90.

The reduction of local pressure increases in the rear volume 48 and the diversion of the reflected sound into the outer region 90 serve to reduce the effects on the oscillation of the membrane 15 and thus also to improve the frequency response of the headphones. Additionally, the distribution of the sound throughout the entire rear volume 48 means that the path of the sound into the front volume 17 is associated with additional reflections for much of the sound, and this in turn leads to a reduction of the sound that passes from the rear volume 48 into the front volume 17.

Optionally, the convex rear wall 20 which delimits the rear volume 48 may be constructed so separately from the housing 41. The outer shape of the housing 41 may then be designed for with a view to aesthetic appearance, independently of the convex rear wall 20, without limiting the use of the convex rear wall 20 according to the invention for the acoustic design of the headphones. The same applies for the funnel-like construction of the peripheral section 49. It is important that the should which is radiated from the rear side of the membrane 15 reaches the convex rear wall 20 and the peripheral section 49, so that a contiguous, acoustically effective rear volume 48 is created that is delimited by the convex rear wall 20 and the peripheral section 49. The external shape of the headphone earcup 40 may be given a design which differs from the shape of the acoustically effective rear volume 48 by the addition of a decorative cap, for example.

Figure 3:
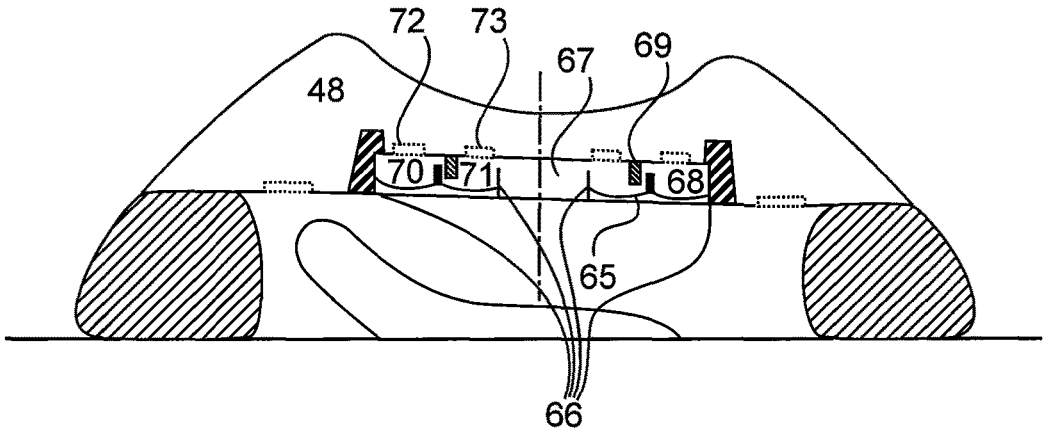
FIG. 3 is a schematic representation of a cross-section through an earcup of a headphone according to a second embodiment.

FIG. 3 is a schematic representation of a cross-section through an earcup of a headphone according to a second embodiment. The second embodiment may be based on the first embodiment. In the second embodiment, a special construction of the sound generator 14 is used. In this context, the sound generator is a ring-shaped dynamic sound transducer such as is described in DE102007005620 particularly for used in open headphones. The sound generator is equipped with a chassis 66 which has a hole 67 in the middle. A membrane 65 is attached by its outer border to the chassis 66, and also has a hole in the middle. The edge of the hole in the membrane 65 is also attached to the chassis 66. The sound generator further includes an annular magnet system 69 which is attached to the chassis 66. A ring-shaped voice coil 68 is attached to the membrane 65, and functions in conjunction with the magnet system 69 when excited electrically to drive the membrane 65 to emit sound. A ring-shaped volume 70 is formed between the outer edge of the chassis 66 and the voice coil 68, which volume may optionally be connected to the rear volume 48 of the headphone earcup via an acoustic resistor 72. A further ring-shaped volume 71, which may optionally be connected to the rear volume 48 of the headphone earcup via an acoustic resistor 73 is created between the voice coil 68 and the inner edge of the chassis 66 which delimits the hole 67. The ring-shaped sound generator according to the second embodiment provides large surface area of the membrane 65 and at the same time ensure that the voice coil 68 has a relatively low tendency to wobble, which is advantageous for distortion-free sound reproduction. In conjunction with the convex baffle 20, a sound generator according to the second embodiment may be used advantageously in a closed headphone.

Figure 4:
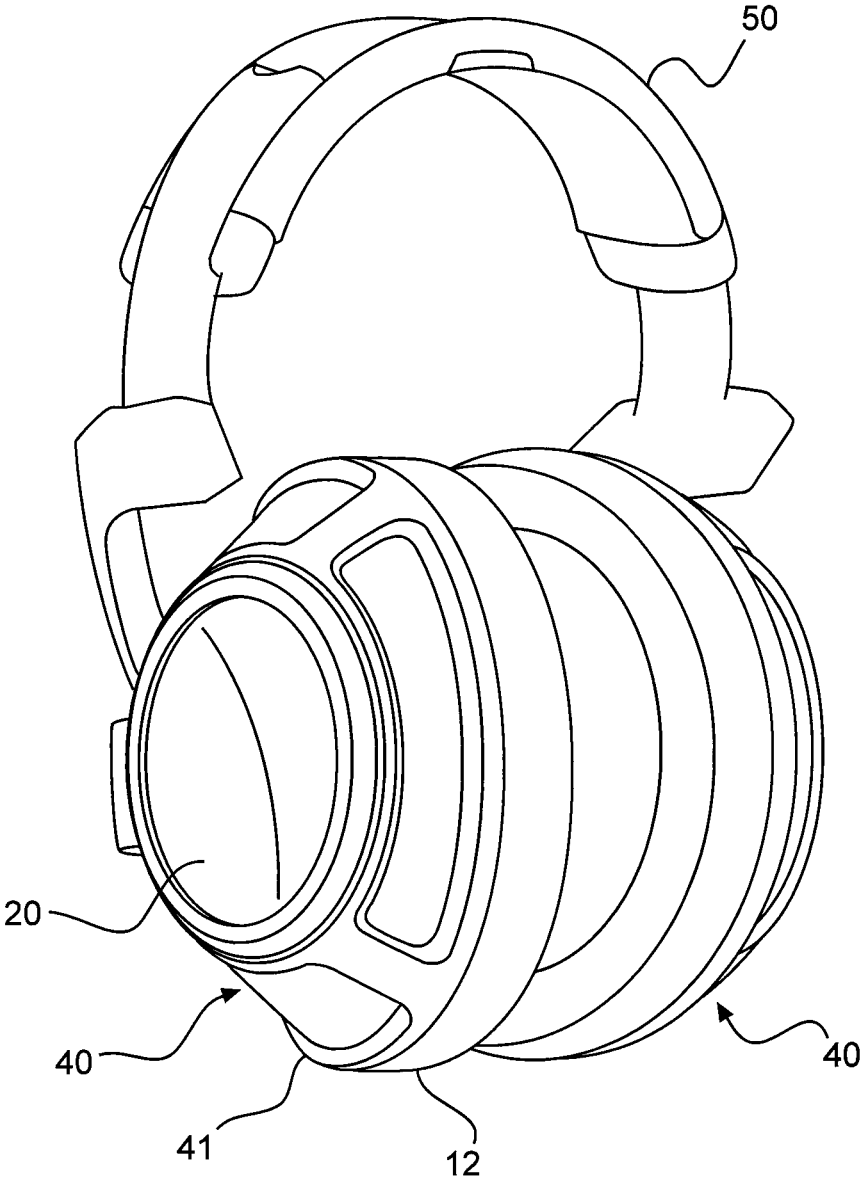
FIG. 4 represents a pair of headphones according to a third embodiment.

FIG. 4 shows a headphone system according to a third embodiment. In this case, two headphone earcups 40 are connected to each other via a headband 50. Both headphone earcups 40 include a housing 41 and an earpad ring 12. In the third embodiment, the housing 41 is designed in such manner that the rear wall 20 which is of convex construction towards the rear volume 48 has a correspondingly concave shape from the outside.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. Headphones comprising:

one or two headphone earcups, wherein each headphone earcup comprises:

an electroacoustic sound generator having a membrane configured to radiate sound;

a baffle configured to support the sound generator, a rear wall;

a peripheral section that is arranged peripherally as a side wall between the rear wall and the baffle; and an earpad ring;

wherein the earpad ring surrounds or lies over an ear of a user when the headphones are used;

wherein the membrane is arranged between the rear wall and the user's ear when the headphones are used;

wherein a rear side of the membrane faces towards the rear wall;

wherein the baffle with the membrane separates a front volume facing towards the user's ear from a rear volume which faces away from the user's ear when the headphones are used;

wherein the rear volume is delimited by the membrane, the baffle, the rear wall, and the peripheral section;

wherein the rear volume is configured as an acoustically contiguous volume, so that sound which is radiated from the rear of the membrane reaches the rear wall;

wherein the rear wall is configured to be convex in such manner that the rear wall is closer to the sound generator in a middle region of the sound generator than at an edge of the sound generator;

wherein the peripheral section is flared progressively from an outer edge of the convex rear wall towards the baffle;

wherein the membrane has an outer diameter and wherein the convex rear wall has a diameter, and wherein the diameter of the convex rear wall is larger than the outer diameter of the membrane;

wherein the rear wall and the peripheral section are configured to be impermeable to sound;

wherein inner sides of the peripheral section converge towards the baffle at an acute angle; and wherein the headphones are configured so that some of the sound radiated from the rear side of the membrane is reflected by the convex rear wall into an outer region of the rear volume in which the inner sides of the peripheral section converge towards the baffle at an acute angle such that multiple irregular reflections are caused which result in an attenuation of the sound that is reflected into the outer region of the rear volume.

2. The headphones according to claim 1;

wherein the side walls of the rear volume formed by the peripheral section are not aligned parallel to each other.

3. The headphones according to claim 1;

wherein the baffle has apertures that are covered with acoustic resistors made of an open-pored material.

* * * * *